US006221207B1

(12) United States Patent
Forslund et al.

(10) Patent No.: US 6,221,207 B1
(45) Date of Patent: Apr. 24, 2001

(54) OXYGEN DELIGNIFICATION OF PULP IN TWO STAGES WITH LOW PRESSURE STEAM HEATING BETWEEN STAGES

(75) Inventors: Kjell Forslund; Rune Larsson, both of Sundsbruk; Matts Sundin, Alnö; Monica Bokström, Kovland, all of (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/155,119

(22) PCT Filed: Mar. 7, 1997

(86) PCT No.: PCT/SE97/00392

§ 371 Date: Sep. 22, 1998

§ 102(e) Date: Sep. 22, 1998

(87) PCT Pub. No.: WO97/36042

PCT Pub. Date: Oct. 2, 1997

(30) Foreign Application Priority Data

Mar. 26, 1996 (SE) ..... 9601160
Jul. 5, 1996 (SE) ..... 9602686

(51) Int. Cl.[7] ..... D21C 9/147; D21C 9/16

(52) U.S. Cl. ..... 162/47; 162/65; 162/68; 162/78

(58) Field of Search ..... 162/47, 60, 65, 162/78, 68

(56) References Cited

U.S. PATENT DOCUMENTS 3,668,063 * 6/1972 Engstrom ..... 162/65
3,719,552 * 3/1973 Farley et al. ..... 162/78
3,944,463 * 3/1976 Samuelson et al. ..... 162/65
3,963,561 * 6/1976 Richter ..... 162/65
4,198,266 * 4/1980 Kirk et al. ..... 162/65
5,217,575 * 6/1993 Backlund ..... 162/65
5,306,391 * 4/1994 Cirucci et al. ..... 162/49
5,460,696 * 10/1995 Kirschner et al. ..... 162/65
5,607,545 * 3/1997 Henricson et al. ..... 162/65
5,690,786 * 11/1997 Cirucci et al. ..... 162/65

FOREIGN PATENT DOCUMENTS 2132056 3/1995 (CA) .
9403074 3/1996 (SE) .
93/00470 1/1993 (WO) .
94/25669 11/1994 (WO) .

OTHER PUBLICATIONS

"Alkaline Pulping", *Pulp and Paper Manufacture*, Third Edition, vol. 5, 1989, pp. 411–414.
"Current State of the Art of EO, EP and EPO Technologies". Non Chlorine Bleaching Conference, Hilton Head, S.C.USA, Mar. 1992.

* cited by examiner

*Primary Examiner*—Steve Alvo
(74) *Attorney, Agent, or Firm*—Lerner, David, Littenberg, Krumholz & Mentlik, LLP

(57) ABSTRACT

Methods for oxygen delignification of chemical pulps are disclosed including contacting the chemical pulp with oxygen first in an upstream reactor vessel and then in a downstream reactor vessel. The upstream reactor vessel is maintained at pressures of greater than about 3 bar, and the downstream reactor vessel is maintained at temperatures of between about 90 and 120° C. and corresponding predetermined pressures. Heating of the partially delignified chemical pulp between the upstream and downstream reactors is accomplished by contacting the partially delignified chemical pulp with low pressure steam.

8 Claims, 1 Drawing Sheet

OXYGEN DELIGNIFICATION OF PULP IN TWO STAGES WITH LOW PRESSURE STEAM HEATING BETWEEN STAGES

FIELD OF THE INVENTION

The present invention relates to oxygen delignification of chemical pulp and, more precisely, to such oxygen delignification in two stages.

BACKGROUND OF THE INVENTION

Swedish developments in the bleaching of chemical pulp have increased the interest in extending delignification with oxygen prior to final bleaching, in order to improve the pulp quality of totally chemical free bleached pulp, i.e. TCF-pulp (Totally Chlorine Free), and in order to facilitate the closing of both TCF-systems and ECF-systems (Elementary Chlorine Free).

Several variations of two-stage systems for oxygen delignification are currently in operation. These systems use, for example, extended retention time, re-mixing, and intermediate treatment for chemical distribution, all of which have become possible by use of a two-stage system. Both of these stages are thus carried out in upstream systems, and are pressurized to various degrees.

The following conditions have been found to be particularly advantageous for such delignification processes:

- in the first stage the chemical concentration (oxygen and liquor) should be high, i.e. it has been found to be advantageous to charge all of the chemicals to the first stage. In other words, it is important to maintain an initially high pressure in order to support the oxygen reactions.
- for extended delignification in the first phase of the oxygen system it is extremely important to maintain a high temperature. If the alkalinity is sufficiently high for a good reaction to take place, no additional chemicals need to be charged to the second stage (the final phase).

These two-stage systems have the most significant disadvantage of requiring much too high investment costs, but also that only high-quality intermediate pressure steam can be used for heating the pulp between the two stages.

SUMMARY OF THE INVENTION

In accordance with the present invention, these and other disadvantages have been overcome by the discovery of a method for the oxygen delignification of a chemical pulp which comprises contacting the chemical pulp with oxygen in an upstream reactor vessel having a top and a bottom by supplying the chemical pulp to the bottom of the upstream vessel and withdrawing a partially oxygen delignified chemical pulp from the top of the upstream vessel, maintaining a pressure of greater than about 3 bar in the upstream reactor vessel, contacting the partially oxygen delignified chemical pulp with oxygen in the downstream reactor having a top and a bottom by supplying the partially oxygen delignified chemical pulp to the top of the downstream reactor vessel and withdrawing oxygen delignified chemical pulp from the bottom of the downstream reactor vessel, maintaining the downstream reactor vessel at a temperature between about 90 and 120° C. and a corresponding predetermined pressure, and heating the partially delignified chemical pulp between the upstream and the downstream reactor vessels by contacting the partially delignified chemical pulp with low pressure steam. A preferred embodiment of the method of the present invention includes adding delignification chemicals to the chemical pulp prior to the upstream reactor vessel.

In accordance with one embodiment of the method of the present invention, the method includes maintaining a gas space at the top of the downstream reactor vessel and the method includes degassing the downstream reactor vessel from the top of the downstream reactor vessel.

In accordance with another embodiment of the method of the present invention, the method includes recovering the heat content from the oxygen delignified pulp. Preferably, such recovery comprises flashing or heating dilution liquid therewith.

In accordance with another embodiment of the method of the present invention, the method includes adding hydrogen peroxide to the partially oxygen delignified chemical pulp prior to the downstream reactor vessel. In a preferred embodiment, the hydrogen peroxide is added in an amount of up to about 5 kg/ton of pulp. Most preferably, the hydrogen peroxide is added by means of a mixer.

A primary object of the present invention is to solve the aforesaid problems by carrying out the two oxygen delignification stages under pressure, in that the first stage is carried out in an upstream reactor vessel and the second stage in a downstream reactor vessel. Further extended delignification, as well as an increase in pulp brightness, are obtained by supplying hydrogen peroxide in amounts of up to 5 kg per ton of pulp, to a mixer located prior to the downstream reactor. A minor adjustment for the increased alkali demand of the peroxide reactions can thus be made in this mixer. By means of this peroxide supply to the downstream reactor the pulp can be delignified to a greater extent and the brightness of the pulp can be increased prior to the final bleaching step. In this manner, closing of the bleaching plane is further facilitated.

The method according to the present invention additionally offers several other advantages, as follows:

- no separate pump is required between the reactors;
- the pulp is heated at the lowest pressure level in the system, so that low pressure
- steam can now be used for heating the pulp;
- possible admixture of additional chemicals, such as hydrogen peroxide, and adjustment of the alkali level, can take place before the second stage in a mixer located at the top of the second reactor vessel;
- due to the fact that the downstream reactor is not filled with pulp, the system can easily be de-aired (degassed) from the top of the downstream reactor vessel;
- the steam recovered by flashing the pulp downstream of the second stage can be used for heating purposes, such as the heating of water;
- the temperature of the pulp at the bottom of the downstream reactor can also be lowered by dilution with colder liquid, thereby making it possible to recover the heat which is not flashed off; and
- the downstream reactor constitutes a buffer by acting both as a reactor and as a storage tower.

BRIEF DESCRIPTION OF THE DRAWING

The present invention may be more fully appreciated with reference to the following detailed description, which, in turn, refers to the drawing which is a schematic representation of a plant for carrying out the method according to the present invention.

DETAILED DESCRIPTION

Figure 1:
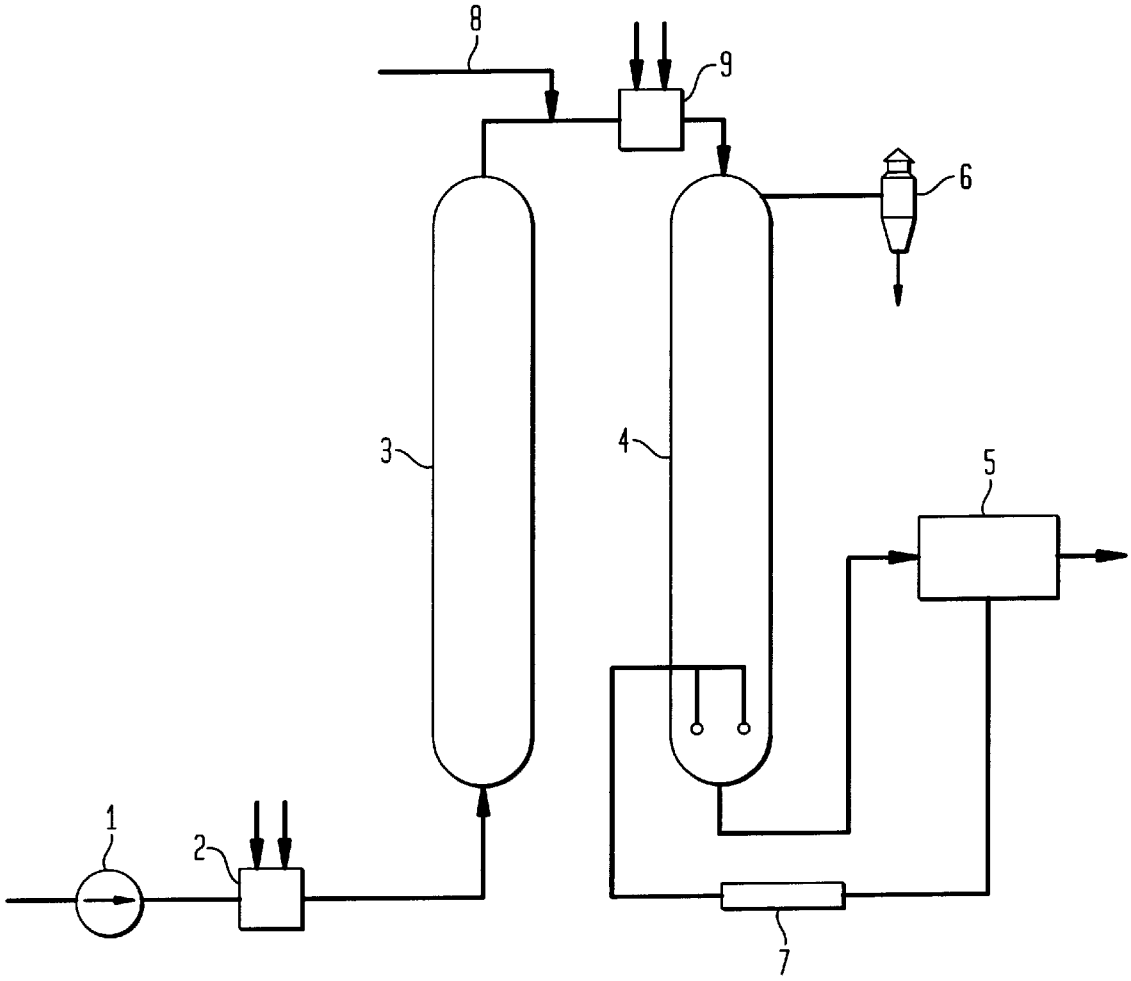

In the plant shown in the drawing unbleached pulp of medium concentration (8–20%) is pumped by a pump 1 to a mixer 2 for the admixture of oxygen and alkali to the pulp. The pulp is then directed to a first oxygen delignification stage consisting of an upstream pressurized reactor vessel 3.

The pulp is charged at the bottom of the reactor and removed at the top. The pulp is then fed to a second oxygen delignification stage consisting of a downstream pressurized reactor vessel 4 in which the pulp is supplied at the top and removed at the bottom of the vessel. Additional chemicals can optimally be admixed between the stages by means of a mixer 9. For example, hydrogen peroxide, in an amount of up to 5 kg per ton of pulp, and a small amount of alkali for adjustment of the alkali level, can be so added. After the second stage the oxygen delignified pulp is directed to subsequent processing stages 5, which can consist of a blow tank where the pulp is flashed, and where recovered steam can be utilized for heating the process water. Stage 5 may also be a washing stage. For cooling the pulp, it is diluted at the bottom of the second reactor by washing filtrate cooled in a heat exchanger 7. Warm water is simultaneously heated in this heat exchanger, and the resulting hot water is used as washing liquid in the process. A container 6 is provided for de-airing the pulp in the vessel 4.

The chemicals (oxygen and alkali) added in the mixer 2 should be sufficient to constitute the principal portion of the total amount required. Preferably, the entire amount of chemicals has already been charged in the first stage. Possible additional chemical charges can be made between the stages.

In the first stage a pressure above 3 bar, preferably from about 3 to 10 bar, is maintained. The temperature should be between about 75 and 100° C.

Because of the fact that the pulp is pumped upward through the first reactor vessel 3, and is thereafter transferred to a downstream reactor vessel 4, no additional pump is required between the reactor vessels.

In the second stage a temperature of between about 90 and 120° C. is maintained, as well as a pressure which is adapted to the temperature, which is sufficiently low to render it possible to use low pressure steam 8 for heating the pulp, preferably at a maximum pressure of about 2 bar. The pulp is preferably heated with low pressure steam between the stages at the lowest pressure level of the system.

In the reactor vessel 4 of the second stage a gas space is maintained at the upper part of the vessel. Degassing of the system can thus be carried out at the top of the vessel. The reactions taking place with oxygen in the second stage take place only with oxygen which is dissolved in the pulp, and with the oxygen remaining after degassing. The pulp leaving the second stage will thereby contain a smaller amount of gas than would otherwise be the case and, therefore, subsequent washing stages can operate more efficiently.

The temperature of the pulp at the bottom of the reactor vessel 4 of the second stage can be lowered by using a colder liquid for dilution. In this manner, the heat which is flashed off can be recovered.

The method of the present invention also renders it possible for the second vessel 4, besides having a function as a reactor for oxygen delignification, to also act as a storage tower for the pulp, thereby serving as a buffer in the system.

The two-stage system for oxygen delignification described above is a much simpler and cheaper method of delignification. Most particularly, the economy of the operation can be improved by heating the pulp between the stages with low pressure steam, instead of the medium pressure steam required in previous systems.

The method according to the present invention thus makes it possible to substantially reduce both investment and operating costs. It is above all now possible to save considerable energy in relation to conventional system for oxygen delignification in two stages.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for the oxygen delignification of a chemical pulp which comprises contacting said chemical pulp with oxygen in an upstream reactor vessel having a top and a bottom by supplying said chemical pulp to said bottom of said upstream reactor vessel and withdrawing a partially oxygen delignified chemical pulp from said top of said upstream reactor vessel, maintaining a pressure of greater than about 3 bar in said upstream reactor vessel, contacting said partially oxygen delignified chemical pulp with oxygen in a downstream reactor vessel having a top and a bottom by supplying said partially oxygen delignified chemical pulp to said top of said downstream reactor vessel and withdrawing oxygen delignified chemical pulp from said bottom of said downstream reactor vessel, maintaining said downstream reactor vessel at a temperature of between about 90° C. and 120° C. and a corresponding predetermined pressure, and heating said partially delignified chemical pulp between said upstream and downstream reactor vessels by contacting said partially delignified chemical pulp with low pressure steam having a pressure of 2 bar or less.

2. The method of claim 1 including adding delignification chemicals to said chemical pulp prior to said upstream reactor vessel.

3. The method of claim 1 including maintaining a gas space at said top of said downstream reactor vessel, and including degassing said downstream reactor vessel from said top of said downstream reactor vessel.

4. The method of claim 1 including recovering the heat content from said oxygen delignified pulp.

5. The method of claim 4 wherein said recovering of said heat content comprises flashing or heating dilution liquid therewith.

6. The method of claim 1 including adding hydrogen peroxide to said partially oxygen delignified chemical pulp prior to said downstream reactor vessel.

7. The method of claim 6 wherein said hydrogen peroxide is added in an amount of up to about 5 kg/ton of pulp.

8. The method of claim 7 wherein said hydrogen peroxide is added by means of a mixer.

* * * * *